US008769828B2

(12) United States Patent
Lau

(10) Patent No.: US 8,769,828 B2
(45) **Date of Patent: *Jul. 8, 2014**

(54) BLADE SET FOR HAIR CLIPPERS

(75) Inventor: Tung Yan Lau, N.T. (HK)

(73) Assignee: Specialife Industries Limited, N.T. (HK)

( * ) Notice: Subject to any disclaimer, the term of this patent is extended or adjusted under 35 U.S.C. 154(b) by 626 days.

This patent is subject to a terminal disclaimer.

(21) Appl. No.: 13/017,036

(22) Filed: Jan. 30, 2011

(65) Prior Publication Data

US 2011/0119929 A1 May 26, 2011

Related U.S. Application Data

(63) Continuation-in-part of application No. 11/623,088, filed on Jan. 14, 2007, now Pat. No. 7,913,399.

(51) Int. Cl.
*B26B 19/06* (2006.01)

(52) U.S. Cl.
USPC ..... 30/208; 30/43.1; 30/223

(58) Field of Classification Search
USPC ..... 30/34.1, 42, 44–46, 194–197, 200, 30/208–210, 216, 223–227, 241, 299, 304, 30/346.57
See application file for complete search history.

(56) References Cited

U.S. PATENT DOCUMENTS

| | | | | |
|---|---|---|---|---|
| 2,274,924 | A * | 3/1942 | Hill | 30/225 |
| 2,883,747 | A * | 4/1959 | Johnson et al. | 30/210 |
| 4,348,810 | A * | 9/1982 | Oda et al. | 30/210 |
| 4,724,614 | A * | 2/1988 | Wahl et al. | 30/200 |
| 4,899,444 | A * | 2/1990 | Trichell et al. | 30/208 |
| 5,504,997 | A * | 4/1996 | Lee | 30/34.1 |
| 5,933,964 | A * | 8/1999 | Altamore | 30/195 |

* cited by examiner

*Primary Examiner* — Laura M Lee

(57) ABSTRACT

A blade set for hair clippers which has a lower fixed blade, an upper fixed blade, a movable blade assembly and a blade holder. The movable blade assembly is flat and extends in a plane parallel to a lengthwise plane of the upper fixed blade and a lengthwise plane of the lower fixed blade and disposed in between the lower fixed blade and the upper fixed blade in such a way that a user's skin is protected from getting injured by the movable blade assembly. A third toothed front edge is provided at a front end of the movable blade assembly, a lower portion of which cooperates with an upper portion of the first toothed front edge to define a first cutting surface, and an upper portion of which cooperates with a lower portion of the second toothed front edge to define a second cutting surface.

19 Claims, 12 Drawing Sheets

BLADE SET FOR HAIR CLIPPERS

BACKGROUND OF THE INVENTION

The present invention relates to a blade set and more particularly pertains to a blade set for hair clippers which has a movable blade disposed between an upper fixed blade and a lower fixed blade and reciprocating laterally relative to the two fixed blades.

Blade sets for hair clippers available in the marketplace generally have a fixed blade and a movable blade. Lateral reciprocation of the movable blade relative to the fixed blade results in a cutting action. Since the movable blade is exposed to users during the cutting action, it is easy for users to get injured by the movable blade.

BRIEF SUMMARY OF THE INVENTION

In view of the aforesaid disadvantages now present in the prior art, the present invention provides a blade set for hair clippers which has one movable blade assembly disposed between an upper fixed blade and a lower fixed blade and reciprocating laterally relative to the two fixed blades. Since the movable blade assembly is covered by the two fixed blades, users are protected from getting injured by the moving blade assembly during the cutting action.

The present invention also provides a blade set for hair clippers with two cutting surfaces formed by three blades and the two cutting surfaces cut hairs on same side of the user's skin at one time. The existence of one extra cutting surface means that the workload for each cutting surface would be shared, thereby reducing the wear and tear of the blades.

The present invention also provides a blade set for hair clippers wherein the teeth of the toothed edges of the upper fixed blade and the lower fixed blade on one side would not overlap with each other. In other words, at any given time, a strand of hair is cut either by the cutting surface between the upper fixed blade and the movable blade assembly, or by the cutting surface between the lower fixed blade and the movable blade assembly, therefore preventing the strand of hair from being pulled simultaneously between the two cutting surfaces and thus reducing the pain caused thereby. Besides, a strand of hair would not be cut twice by both the upper fixed blade and the lower fixed blade, therefore the trouble of cleaning up excessive pieces of cut hair strand could be avoided.

To attain this, the present invention provides a blade set for hair clippers which comprises a lower fixed blade with a first toothed front edge; an upper fixed blade with a second toothed front edge which is disposed on top of the lower fixed blade and aligned corresponding to the lower fixed blade; a movable blade assembly which is flat and extends in a plane parallel to a lengthwise plane of the upper fixed blade and a lengthwise plane of the lower fixed blade and disposed in between the lower fixed blade and the upper fixed blade in such a way that a user's skin is protected from getting injured by the movable blade assembly; a driving means connected to the movable blade assembly to reciprocate the movable blade assembly laterally relative to the lower fixed blade and the upper fixed blade in an operating condition; a third toothed front edge provided at a front end of the movable blade assembly, a lower portion of which cooperates with an upper portion of the first toothed front edge to define a first cutting surface, and an upper portion of which cooperates with a lower portion of the second toothed front edge to define a second cutting surface, and the first cutting surface and the second cutting surface are configured to cut hairs on same side of the user's skin at one time; and a blade holder which secures the lower fixed blade, the movable blade assembly and the upper fixed blade together to form a blade set and the blade set is connected to the hair clippers.

In one embodiment, the teeth of the first toothed front edge and the second toothed front edge do not overlap with each other.

In one embodiment, the lower fixed blade is further provided with a first toothed rear edge opposite to the first toothed front edge; the upper fixed blade is provided with a second toothed rear edge opposite to the second toothed front edge; a rear end of the movable blade assembly is provided with a third toothed rear edge, a lower portion of which cooperates with an upper portion of the first toothed rear edge to define a third cutting surface, and an upper portion of which cooperates with a lower portion of the second toothed rear edge to define a fourth cutting surface, and the third cutting surface and the fourth cutting surface are configured to cut hairs on same side of the user's skin at one time.

In one embodiment, the teeth of the first toothed rear edge and the second toothed rear edge do not overlap with each other.

In one embodiment, the movable blade assembly comprises one blade; the blade is provided with a toothed front edge constituting the third toothed front edge and each tooth thereof has a cross-sectional shape of a rectangle, and the blade is also provided with a toothed rear edge constituting the third toothed rear edge and each tooth thereof has a cross-sectional shape of a rectangle.

In one embodiment, the movable blade assembly comprises a lower movable blade provided with a toothed front edge constituting the lower portion of the third toothed front edge, and an upper movable blade disposed fixedly on top of the lower movable blade and provided with a toothed front edge constituting the upper portion of the third toothed front edge, and the teeth of the toothed front edge of the lower movable blade and the toothed front edge of the upper movable blade overlap with each other; the lower movable blade is provided with a toothed rear edge constituting the lower portion of the third toothed rear edge, and the upper movable blade is provided with a toothed rear edge constituting the upper portion of the third toothed rear edge, and the teeth of the toothed rear edge of the lower movable blade and the toothed rear edge of the upper movable blade overlap with each other.

In one embodiment, each tooth of the toothed front edge of the lower movable blade has a cross-sectional shape of an isosceles trapezoid, and each tooth of the toothed front edge of the upper movable blade has a cross-sectional shape of an inverted isosceles trapezoid; each tooth of the toothed rear edge of the lower movable blade has a cross-sectional shape of an isosceles trapezoid, and each tooth of the toothed rear edge of the upper movable blade has a cross-sectional shape of an inverted isosceles trapezoid.

In one embodiment, each tooth of the first toothed front edge of the lower fixed blade is integrally provided with a first protecting piece extending upward from a front end thereof, and each tooth of the second toothed front edge of the upper fixed blade is integrally provided with a second protecting piece extending downward from a front end thereof, and the thickness of the first and second protecting pieces is adapted to allow the movable blade assembly to reciprocate laterally; each tooth of the first toothed rear edge of the lower fixed blade is integrally provided with a third protecting piece extending upward from a rear end thereof, and each tooth of the second toothed rear edge of the upper fixed blade is integrally provided with a fourth protecting piece extending downward from a rear end thereof, and the thickness of the third and fourth protecting pieces is adapted to allow the movable blade assembly to reciprocate laterally.

In one embodiment, the blade holder further comprises an upper pressing piece and a lower pressing piece; two springs are disposed between the upper pressing piece and the lower pressing piece in such a way to press the lower pressing piece against a top surface of the upper fixed blade. The blade holder further comprises a base; the base is provided with three pins which extend upward towards a lower surface of the lower pressing piece and pass through corresponding openings provided on each of the lower fixed blade, the movable blade assembly and the upper fixed blade, thereby securing the lower fixed blade, the movable blade assembly and the upper fixed blade in an assembled relation. The size of each opening of the movable blade assembly is larger than that of the corresponding pin so as to allow reciprocating actions of the movable blade assembly. A guarding piece is disposed on top of each opening of the movable blade assembly for protecting the movable blade assembly from wear and tear during reciprocation. The driving means is provided with a first connecting piece at a front end thereof and a second connecting piece at a rear end thereof. The driving means passes through an opening provided at the upper pressing piece, an opening provided at the lower pressing piece, an opening provided at the upper fixed blade, an opening provided at the movable blade assembly, and an opening provided at the lower fixed blade; the opening of the movable blade assembly is sized to fittingly receive portion of the driving means passing through the opening. The movable blade assembly is provided with two notches corresponding to the first connecting piece and the second connecting piece respectively for receiving the first connecting piece and the second connecting piece. The opening of the upper pressing piece, the opening of the lower pressing piece, the opening of the upper fixed blade and the opening of the lower fixed blade are sized to be larger than portion of the driving means passing through the respective openings. The upper fixed blade and the lower fixed blade are each provided with a notch corresponding to the first connecting piece for receiving the first connecting piece, and the two notches are sized to be larger than the first connecting piece to allow reciprocating action of the driving means and the movable blade assembly.

It is an object of the present invention to provide a new blade set which allows safer hair cutting operation by placing the movable blade assembly in between the upper fixed blade and the lower fixed blade, thus overcoming the disadvantages of the prior art.

It is another object of the present invention to provide a new blade set which is of simple and reliable construction.

It is a further object of the present invention to provide a new blade set which is susceptible of a low cost of manufacture with regard to both materials and labor, and which accordingly is then susceptible of low prices of sale to the consuming public, thereby making such blade set economically available to the buying public.

DETAILED DESCRIPTION OF THE INVENTION

Figure 1:
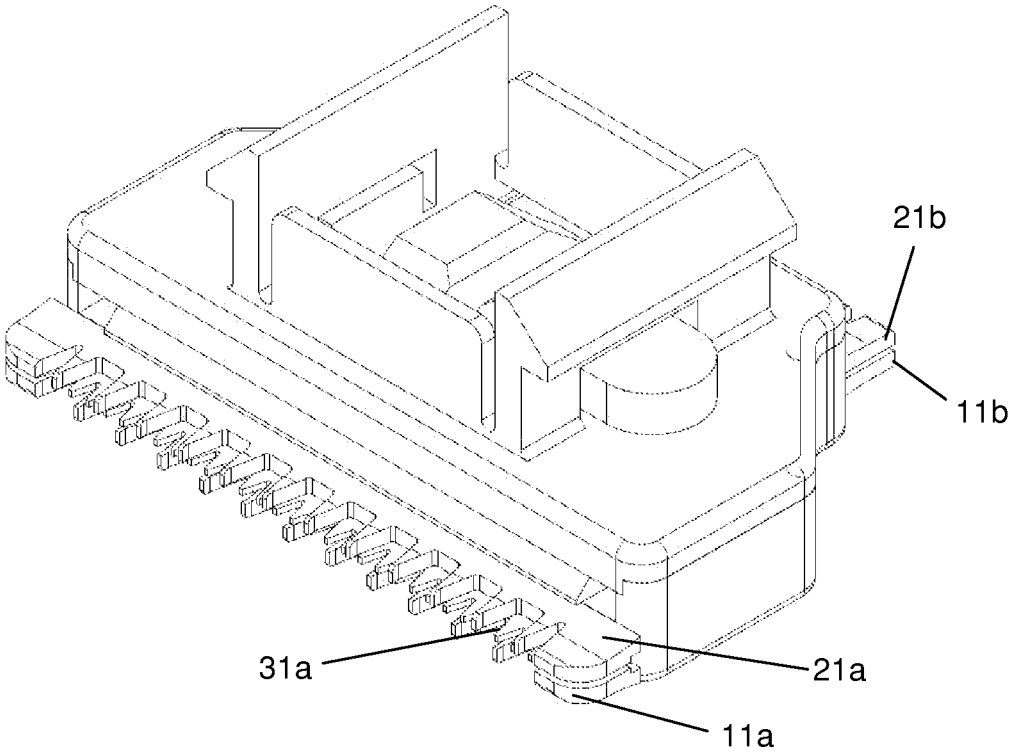
FIG. 1 shows a perspective view of the blade set of the first embodiment of the present invention.
Figure 2:
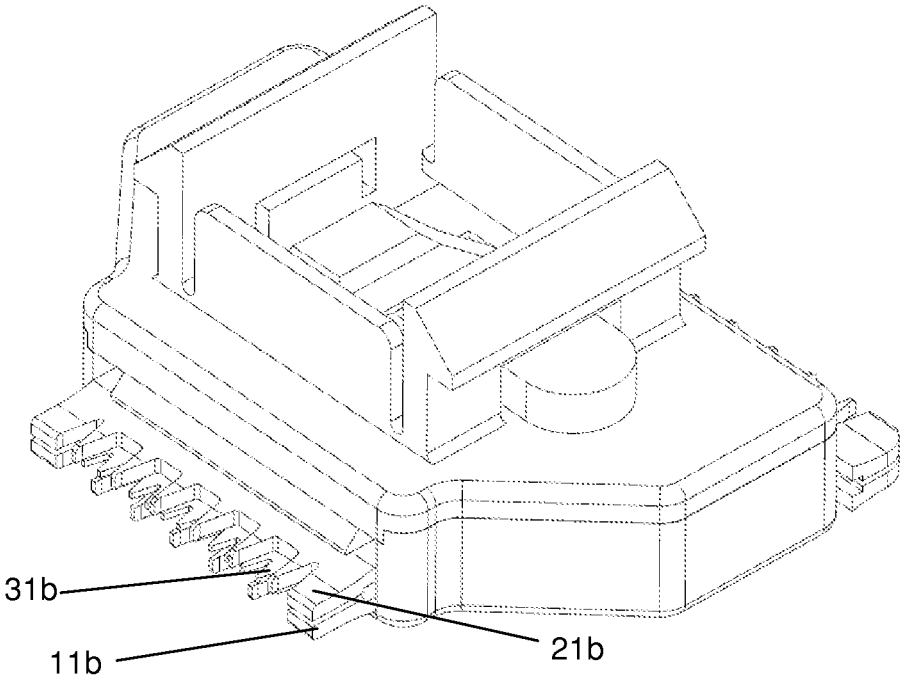
FIG. 2 shows another perspective view of the blade set of the first embodiment of the present invention.
Figure 3:
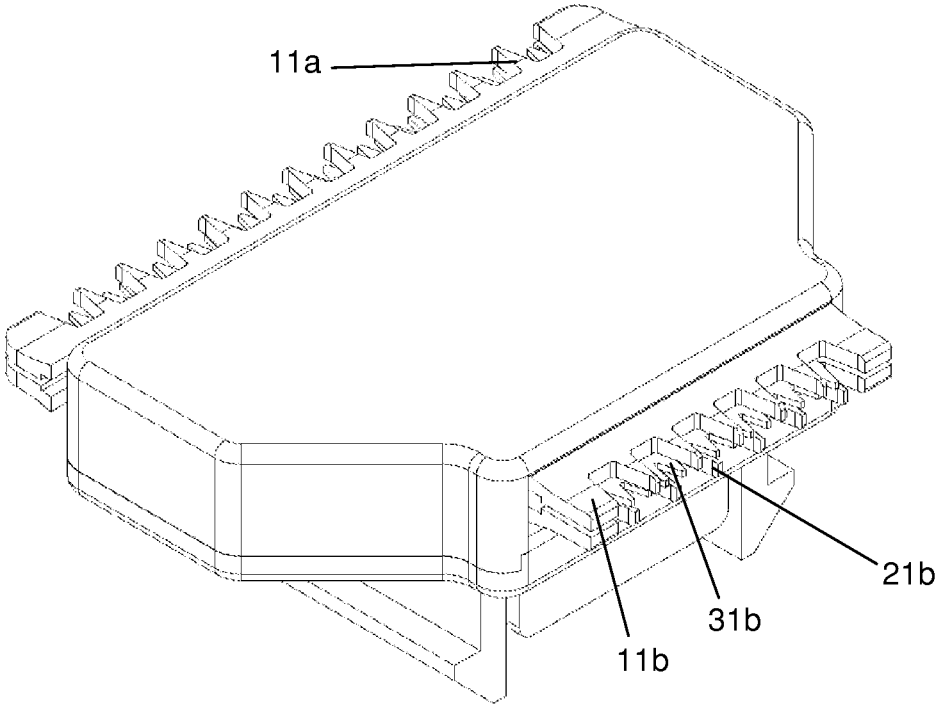
FIG. 3 shows yet another perspective view of the blade set of the first embodiment of the present invention.
Figure 4:
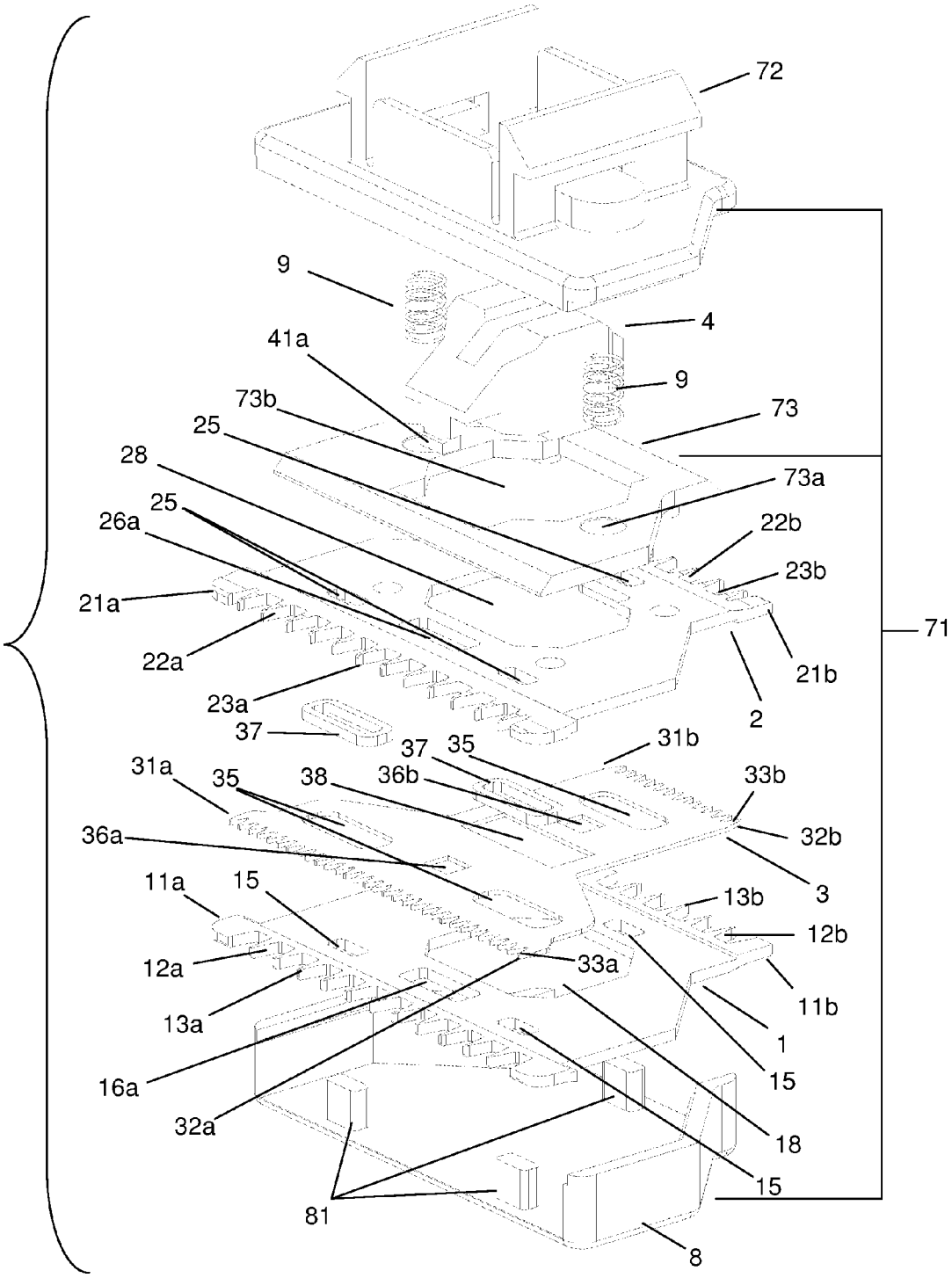
FIG. 4 shows the exploded view of the blade set of the first embodiment of the present invention.
Figure 5:
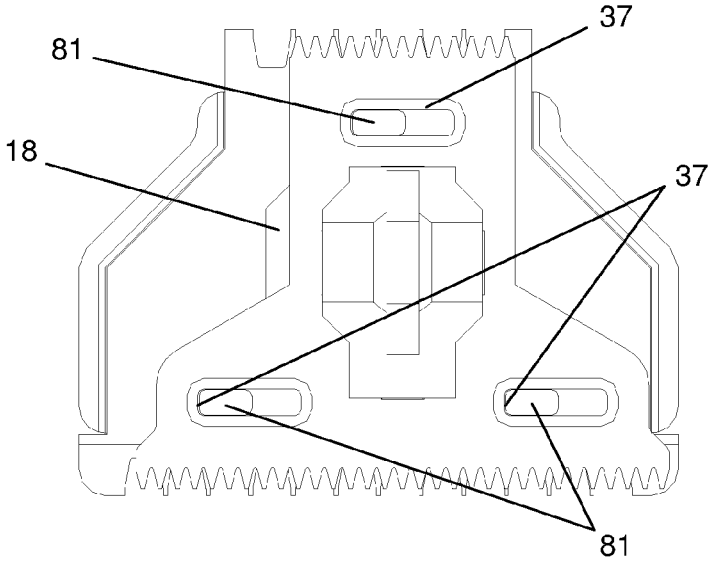
FIG. 5 shows a top plan view with the upper fixed blade removed to illustrate the movement of the movable blade assembly of the first embodiment of the present invention.
Figure 6:
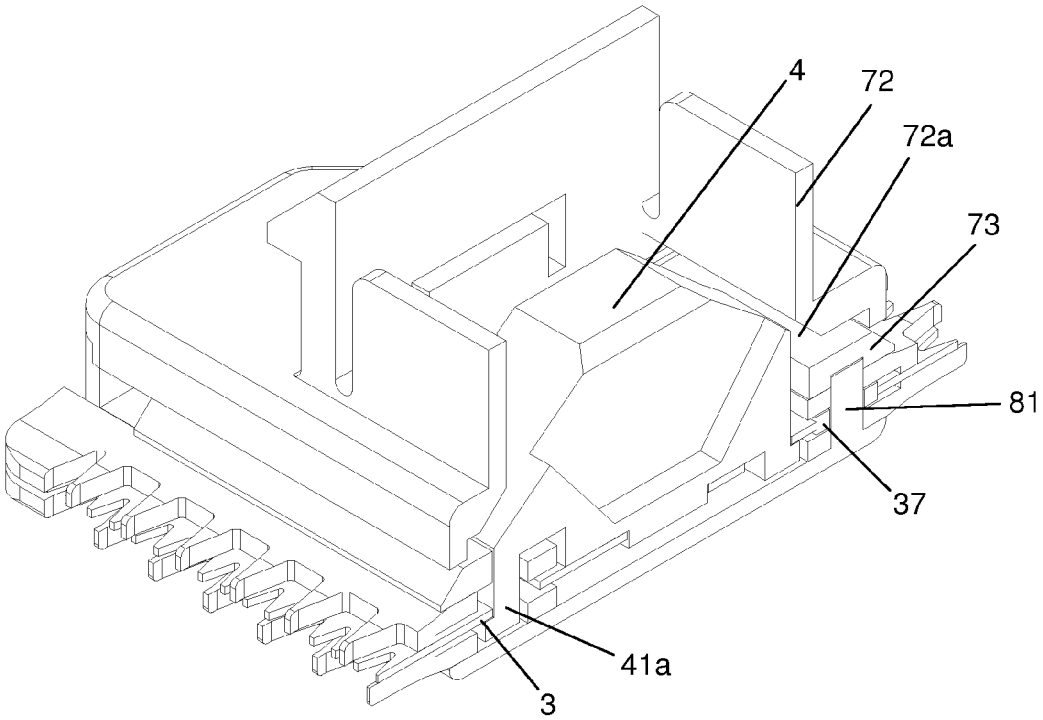
FIG. 6 shows a sectional view of the blade set of the first embodiment of the present invention.
Figure 7:
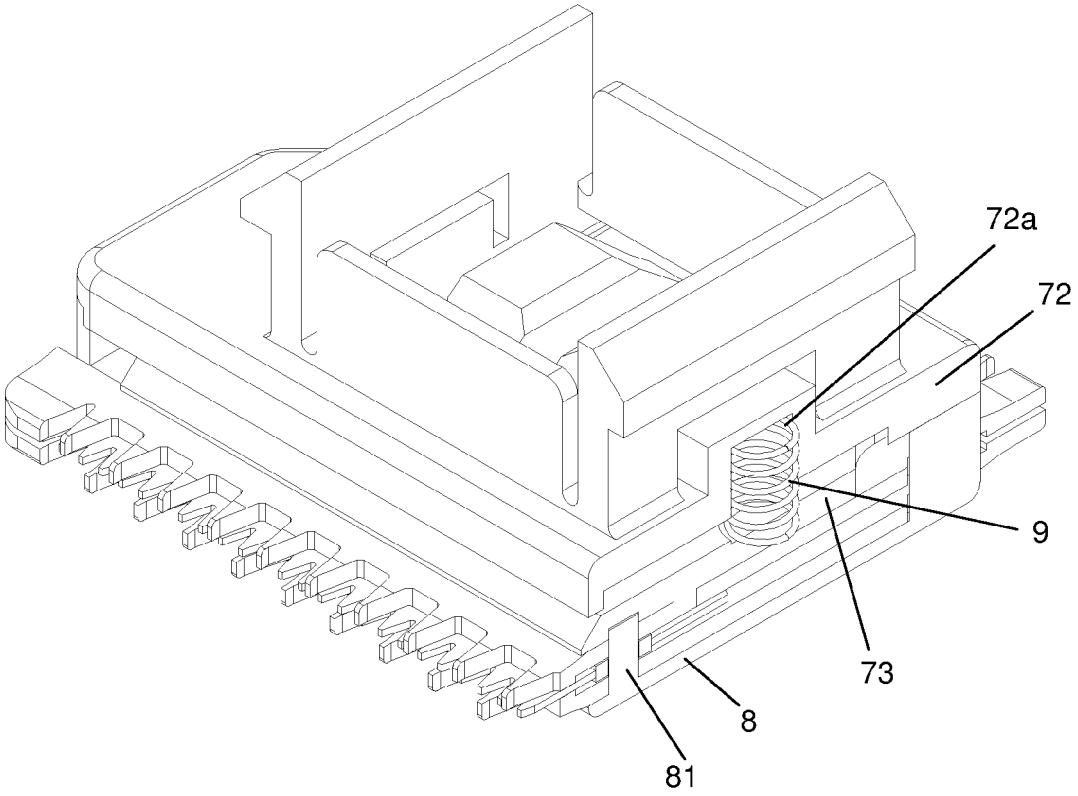
FIG. 7 shows another sectional view of the blade set of the first embodiment of the present invention.

The present invention is further described in detail with the following embodiments and the accompanying drawings. FIGS. 1 to 7 illustrate the first embodiment of the present invention. As illustrated, the present invention comprises a lower fixed blade 1, an upper fixed blade 2, a movable blade assembly 3 and a blade holder 71. The lower fixed blade 1 is provided with a first toothed front edge 11*a* and a first toothed rear edge 11*b* opposite thereto. The upper fixed blade 2 is disposed on top of the lower fixed blade 1 and aligned corresponding to the lower fixed blade 1, and is provided with a second toothed front edge 21*a* and a second toothed rear edge 21*b* opposite thereto. In this embodiment, the teeth 12*a*, 22*a* of the first toothed front edge 11*a* and the second toothed front edge 12*a* do not overlap with each other, and the teeth 12*b*, 22*b* of the first toothed rear edge 11*b* and the second toothed rear edge 21*b* also do not overlap with each other. In other words, at any given time, a strand of hair is cut either by the cutting surface between the upper fixed blade 2 and the movable blade assembly 3, or by the cutting surface between the lower fixed blade 1 and the movable blade assembly 3, therefore preventing the strand of hair from being pulled simultaneously between the two cutting surfaces and thus reducing the pain caused thereby. Besides, a strand of hair would not be cut twice by both the upper fixed blade 2 and the lower fixed blade 1, therefore the trouble of cleaning up excessive pieces of cut hair strand could be avoided. In other embodiments (not shown), the teeth of the first toothed front edge and the second toothed front edge may overlap with each other, and the teeth of the first toothed rear edge and the second toothed rear edge may also overlap with each other. The movable blade assembly 3 is flat and extends in a plane parallel to a lengthwise plane of the upper fixed blade 2 and a lengthwise plane of the lower fixed blade 1, and is disposed in between the lower fixed blade 1 and the upper fixed blade 2 in such a way that a user's skin is protected from getting injured by the movable blade assembly 3. In this embodiment, the movable blade assembly 3 comprises one blade. A driving means 4 is connected to the movable blade assembly 3 to reciprocate the movable blade assembly 3 laterally relative to the lower fixed blade 1 and the upper fixed blade 2 in an operating condition. The driving means 4 is driven by a driving unit (not shown) in the hair clipper (not shown). A third toothed front edge 31*a* is provided at a front end of the movable blade assembly 3, a lower portion 32*a* of which cooperates with an upper portion 13*a* of the first toothed front edge 11*a* to define a first cutting surface, and an upper portion 33*a* of which cooperates with a lower portion 23*a* of the second toothed front edge 21*a* to define a second cutting surface, and the first cutting surface and the second cutting surface are configured to cut hairs on same side of the user's skin at one time. A third toothed rear edge 31*b* is provided at a rear end of the movable blade assembly 3, a lower portion 32*b* of which cooperates with an upper portion 13*b* of the first toothed rear edge 11*b* to define a third cutting surface, and an upper portion 33*b* of which cooperates with a lower portion 23*b* of the second toothed rear edge 21*b* to define a fourth cutting surface, and the third cutting surface and the fourth cutting surface are configured to cut hairs on same side of the user's skin at one time. The blade holder 71 secures the lower fixed blade 1, the movable blade assembly 3 and the upper fixed blade 2 together to form a blade set and the blade set is connected to a hair clipper (not shown).

In this embodiment, the blade holder 71 comprises an upper pressing piece 72 and a lower pressing piece 73. Two springs 9 are disposed between the upper pressing piece 72 and the lower pressing piece 73 in such a way to press the lower pressing piece 73 against a top surface of the upper fixed blade 2. More particularly, the lower pressing piece 73 is provided with two recesses 73*a* for receiving the lower portions of the two springs 9 respectively, and the upper pressing piece 72 is provided with two receptacles 72*a* for receiving the upper portions of the two springs 9 respectively. The springs 9 are slightly compressed when the upper pressing piece 72 and the lower pressing piece 73 are assembled so that the springs 9 could exert pressure against the lower pressing piece 73.

In this embodiment, the blade holder 71 further comprises a base 8. The base 8 is provided with three pins 81 which extend upward towards a lower surface of the lower pressing piece 73 and pass through corresponding openings 15, 35, 25 provided on each of the lower fixed blade 1, the movable blade assembly 3 and the upper fixed blade 2, thereby securing the lower fixed blade 1, the movable blade assembly 3 and the upper fixed blade 2 in an assembled relation. The size of each opening 35 of the movable blade assembly 3 is larger than that of the corresponding pin 81 so as to allow reciprocating actions of the movable blade assembly 3. A guarding piece 37 is disposed on top of each opening 35 of the movable blade assembly 3 for protecting the movable blade assembly 3 from wear and tear during reciprocation.

In this embodiment, the driving means 4 is provided with a first connecting piece 41*a* at a front end thereof and a second connecting piece 41*b* at a rear end thereof. The driving means 4 passes through an opening 72*a* provided at the upper pressing piece 72, an opening 73*b* provided at the lower pressing piece 73, an opening 28 provided at the upper fixed blade 2, an opening 38 provided at the movable blade assembly 3, and an opening 18 provided at the lower fixed blade 1. In order to enable the movable blade assembly 3 to be driven by the driving means 4, the opening 38 of the movable blade assembly 3 is sized to fittingly receive the portion of the driving means 4 passing through the opening 38; besides, the movable blade assembly 3 is provided with two notches 36*a*, 36*b* corresponding to the first connecting piece 41*a* and the second connecting piece 41*b* respectively for receiving the first connecting piece 41*a* and the second connecting piece 41*b*. To allow the reciprocating action of the driving means 4 and the movable blade assembly 3, the opening 72*a* of the upper pressing piece 72, the opening 73*b* of the lower pressing piece 73, the opening 28 of the upper fixed blade 2 and the opening 18 of the lower fixed blade 1 are sized to be larger than the portion of the driving means 4 passing through the respective openings; besides, the upper fixed blade 2 and the lower fixed blade 1 are each provided with a notch 26*a*, 16*a* corresponding to the first connecting piece 41*a* for receiving the first connecting piece 41*a*, and the two notches 16*a*, 26*a* are sized to be larger than the first connecting piece 41*a* to allow reciprocating action of the driving means 4 and the movable blade assembly 3.

Figure 8:
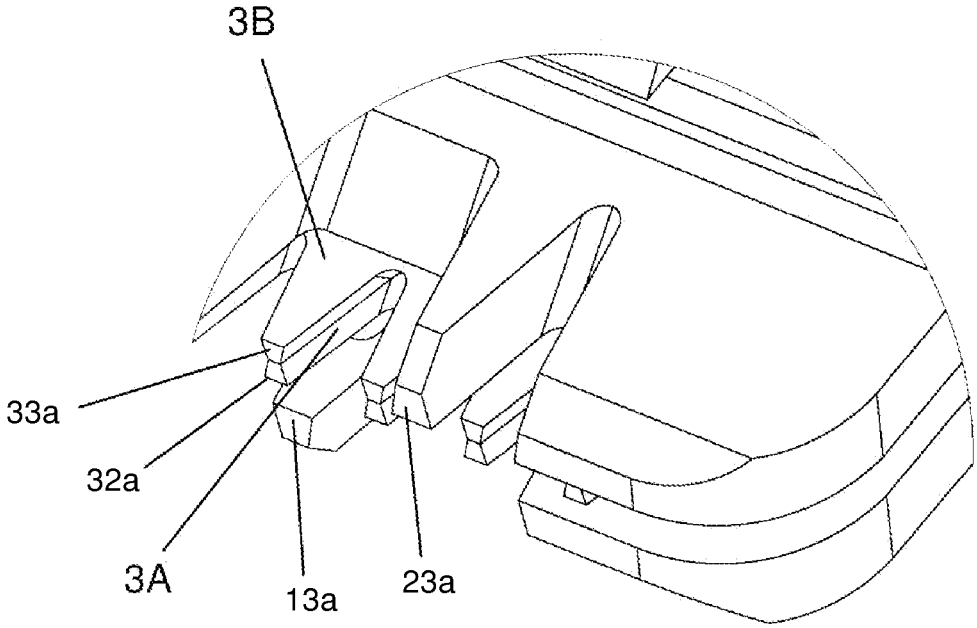
FIG. 8 shows a partial perspective view of a second embodiment of the present invention.

FIG. 8 illustrates the second embodiment of the present invention. The second embodiment is similar to the first embodiment except for the following. In this embodiment, the movable blade assembly 3 comprises a lower movable blade 3A provided with a toothed front edge constituting the lower portion 32*a* of the third toothed front edge, and an upper movable blade 3B disposed fixedly on top of the lower movable blade 3A and provided with a toothed front edge constituting the upper portion 33*a* of the third toothed front edge 31*a*, and the teeth of the toothed front edge of the lower movable blade 3A and the toothed front edge of the upper movable blade 3B overlap with each other. Each tooth of the toothed front edge of the lower movable blade 3A has a cross-sectional shape of an isosceles trapezoid, and each tooth of the toothed front edge of the upper movable blade 3B has a cross-sectional shape of an inverted isosceles trapezoid. Similarly (not shown), the lower movable blade is provided with a toothed rear edge constituting the lower portion of the third toothed rear edge, and the upper movable blade is provided with a toothed rear edge constituting the upper portion of the third toothed rear edge, and the teeth of the toothed rear edge of the lower movable blade and the toothed rear edge of the upper movable blade overlap with each other. Each tooth of the toothed rear edge of the lower movable blade has a cross-sectional shape of an isosceles trapezoid, and each tooth of the toothed rear edge of the upper movable blade has a cross-sectional shape of an inverted isosceles trapezoid. Other structures of this embodiment are similar to those of the first embodiment and are therefore not described in detail.

Figure 9:
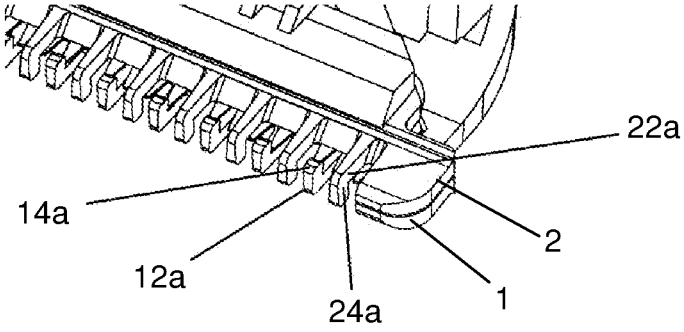
FIG. 9 shows a partial perspective view of a third embodiment of the present invention.
Figure 10:
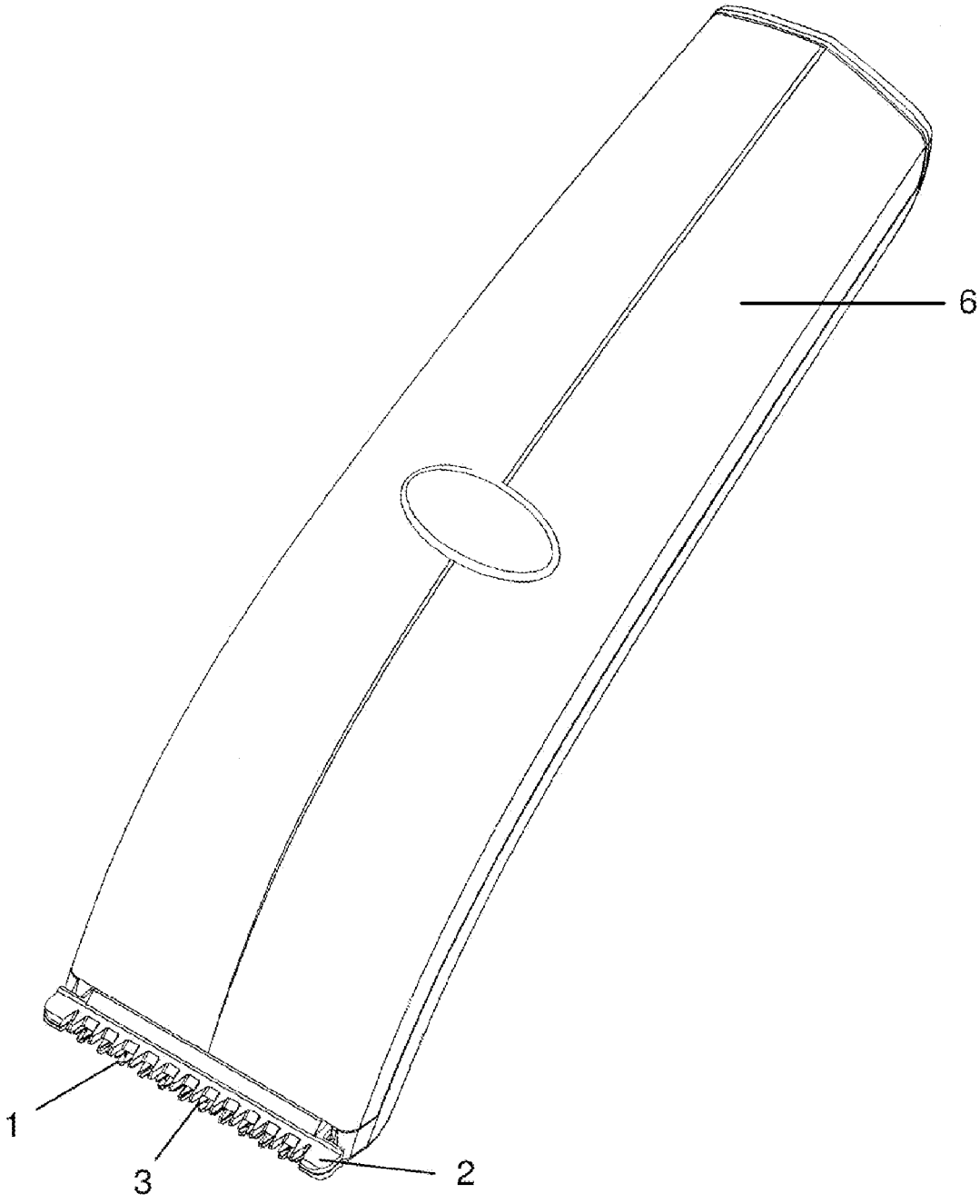
FIG. 10 shows the perspective view of the blade set of the fourth embodiment as connected to a hair clipper.
Figure 11:
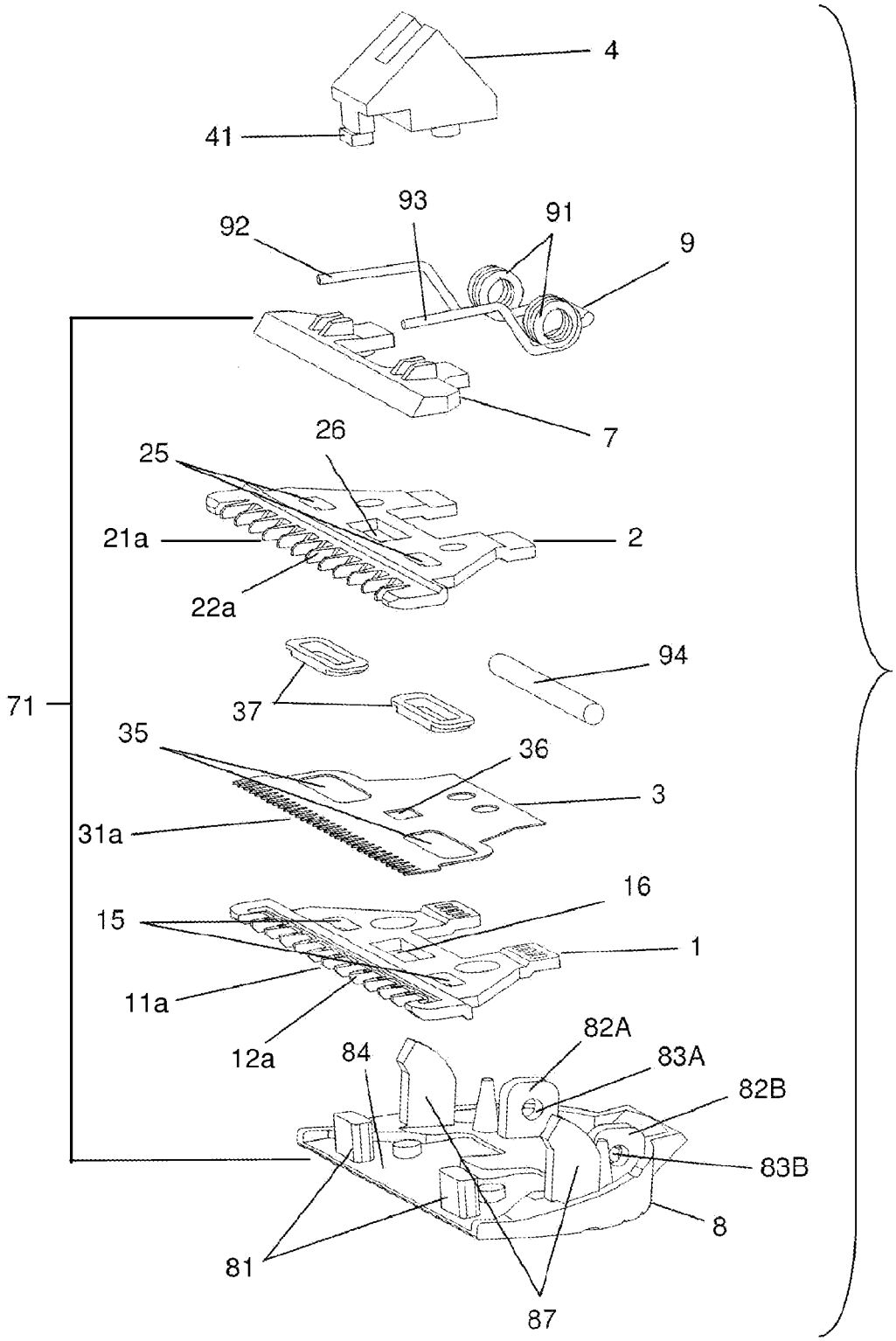
FIG. 11 shows the exploded view of the blade set of the fourth embodiment.
Figure 12:
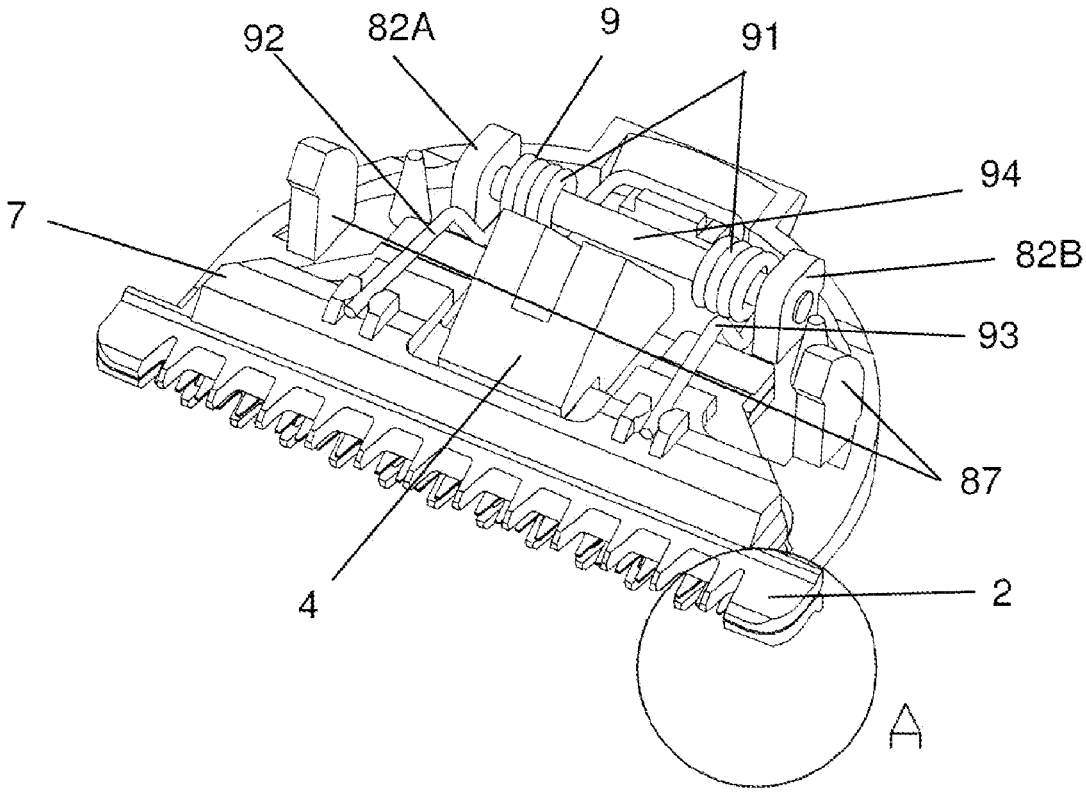
FIG. 12 shows the perspective view of the assembled blade set of the fourth embodiment.
Figure 13:
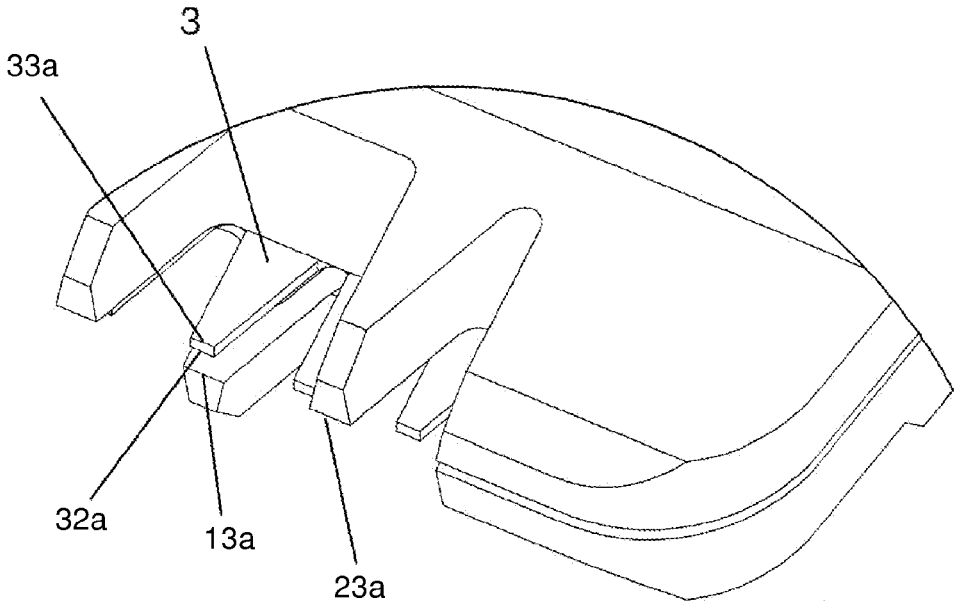
FIG. 13 shows the enlarged view of the portion A of FIG. 12.
Figure 14:
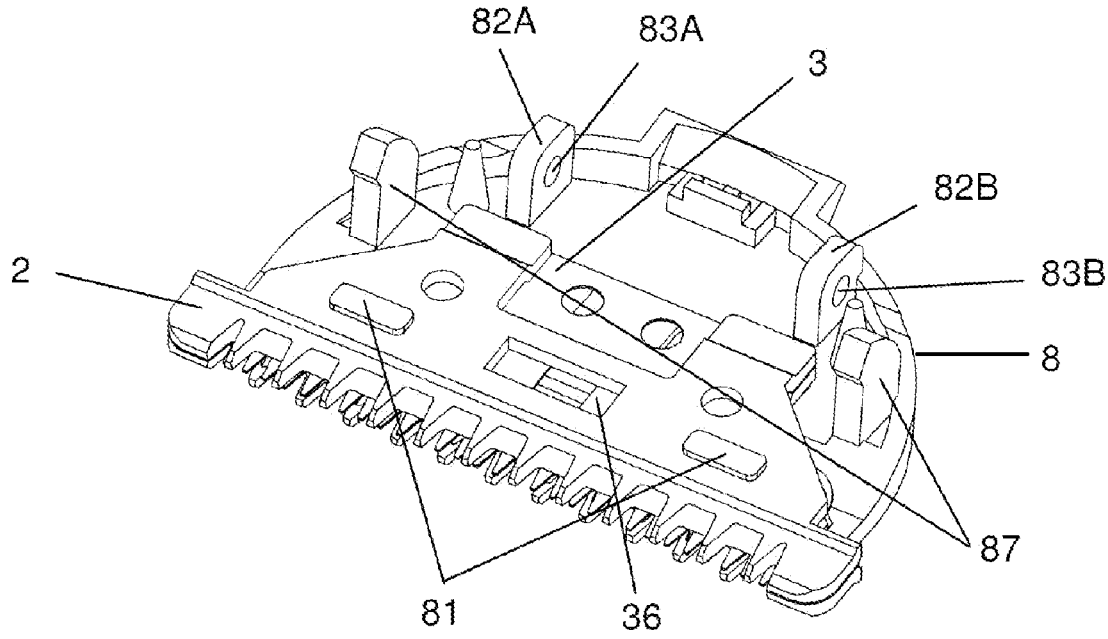
FIG. 14 shows the perspective view of the semi-assembled blade set of the fourth embodiment.

FIG. 9 illustrates the third embodiment of the present invention. The third embodiment is similar to the first embodiment except for the following. In this embodiment, each tooth 12*a* of the first toothed front edge of the lower fixed blade 1 is integrally provided with a first protecting piece 14*a* extending upward from a front end thereof, and each tooth 22*a* of the second toothed front edge of the upper fixed blade 2 is integrally provided with a second protecting piece 24*a* extending downward from a front end thereof, and the thickness of the first and second protecting pieces 14*a*, 24*a* is adapted to allow the movable blade assembly 3 to reciprocate laterally. Similarly (not shown), each tooth of the first toothed rear edge of the lower fixed blade is integrally provided with a third protecting piece extending upward from a rear end thereof, and each tooth of the second toothed rear edge of the upper fixed blade is integrally provided with a fourth protecting piece extending downward from a rear end thereof, and the thickness of the third and fourth protecting pieces is adapted to allow the movable blade assembly to reciprocate laterally. Other structures of this embodiment are similar to those of the first embodiment and are therefore not described in detail.

FIGS. 10 to 14 illustrate the fourth embodiment of the present invention. As illustrated, the present invention comprises a lower fixed blade 1, an upper fixed blade 2, a movable blade assembly 3 and a blade holder 71. The lower fixed blade 1 is provided with a first toothed front edge 11*a*. The upper fixed blade 2 is provided with a second toothed front edge 21*a* which is disposed on top of the lower fixed blade 1 and aligned corresponding to the lower fixed blade 1 so that the teeth 12*a*, 22*a* of the first toothed front edge 11*a* and the second toothed front edge 12*a* do not overlap with each other. In other words, at any given time, a strand of hair is cut either by the cutting surface between the upper fixed blade 2 and the movable blade assembly 3, or by the cutting surface between the lower fixed blade 1 and the movable blade assembly 3, therefore preventing the strand of hair from being pulled simultaneously between the two cutting surfaces and thus reducing the pain caused thereby. Besides, a strand of hair would not be cut twice by both the upper fixed blade 2 and the lower fixed blade 1, therefore the trouble of cleaning up excessive pieces of cut hair strand could be avoided. The movable blade assembly 3 is disposed in between the lower fixed blade 1 and the upper fixed blade 2 and is connected to a driving means 4 driven by a driving unit (not shown) in the hair clipper 6 to reciprocate laterally relative to the lower fixed blade 1 and the upper fixed blade 2 in an operating condition. The blade holder 71 secures the lower fixed blade 1, the movable blade assembly 3 and the upper fixed blade 2 together to form a blade set and the blade set is connected to the hair clipper 6. The blade holder 71 comprises a pressing piece 7 and a base 8 secured under the lower fixed blade 1 and connected to the pressing piece 7. The pressing piece 7 presses against a top surface of the upper fixed blade 2. The base 8 is provided with a recess 84 at its front end for receiving the lower fixed blade 1, and the shape of the recess 84 corresponds to that of the lower fixed blade 1.

The movable blade assembly 3 in this embodiment comprises one blade with a third toothed front edge 31*a* and each tooth thereof has a cross-sectional shape of a rectangle. The third toothed front edge 31*a* is provided at a front end of the movable blade assembly 3. A lower portion 32*a* of the third toothed front edge 31*a* cooperates with an upper portion 13*a* of the first toothed front edge 11*a* to define a first cutting surface. An upper portion 33*a* of third toothed front edge 31*a* cooperates with a lower portion 23*a* of the second toothed front edge 21*a* to define a second cutting surface.

In this embodiment, the base 8 is provided with two pins 81 which extend upward towards a lower surface of the pressing piece 7 and pass through corresponding openings 15, 35, 25 provided on each of the lower fixed blade 1, the movable blade assembly 3 and the upper fixed blade 2, thereby securing the lower fixed blade 1, the movable blade assembly 3 and the upper fixed blade 2 in an assembled relation. The size of each opening 35 of the movable blade assembly 3 is larger than that of the corresponding pin 81 so as to allow reciprocating actions of the movable blade assembly 3. A guarding piece 37 is disposed on top of each opening 35 of the movable blade assembly 3 for protecting the movable blade assembly 3 from wear and tear during reciprocation.

In this embodiment, the base 8 and the pressing piece 7 are connected to each other by means of a torsion spring 9. The torsion spring 9 comprises a coil member 91 and two ends 92, 93 and is connected to the base 8 via a rod 94. The rod 94 passes through the coil member 91 and is disposed at a rear end of the base 8. The two ends 92, 93 of the torsion spring 9 are attached to the pressing piece 7, and the pressure exerted by the pressing piece 7 against the upper fixed blade 2, the movable blade assembly 3 and the lower fixed blade 1 enables the three blades to be secured in an assembled relation. The rear end of the base 8 is provided with two walls 82A, 82B opposite to each other, one on the left side and one on the right side, and each wall 82A, 82B is provided with a through hole 83A, 83B in the middle for receiving one end of the rod 94.

In this embodiment, the driving means 4 is provided with a connecting piece 41, and the upper fixed blade 2, the lower fixed blade 1 and the movable blade assembly 3 are each provided with a notch 26, 16, 36 corresponding to the connecting piece 41 for receiving the connecting piece 41. The connecting piece 41 passes through corresponding notches 26, 36, 16 provided on each of the upper fixed blade 2, the movable blade assembly 3 and the lower fixed blade 1. The size of each notch 26, 16 of the upper fixed blade 2 and the lower fixed blade 1 is larger than that of the corresponding connecting piece 41 so as to allow reciprocating action of the connecting piece 41. In other embodiments, it is possible for the connecting piece to pass through the corresponding notch in the movable blade assembly only. The base 8 is provided with two protrusions 87, one on left side and one on right side, for connecting the blade set to the hair clipper 6.

Figure 15:
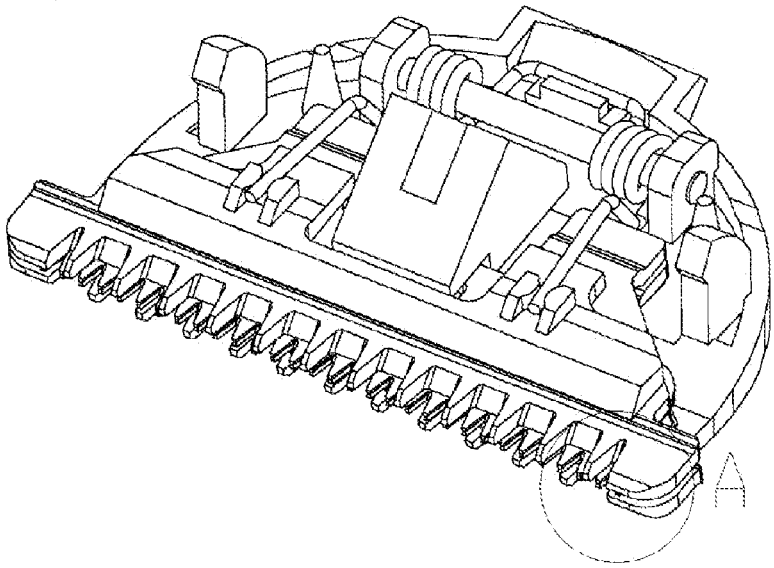
FIG. 15 shows the perspective view of the assembled blade set of the fifth embodiment.
Figure 16:
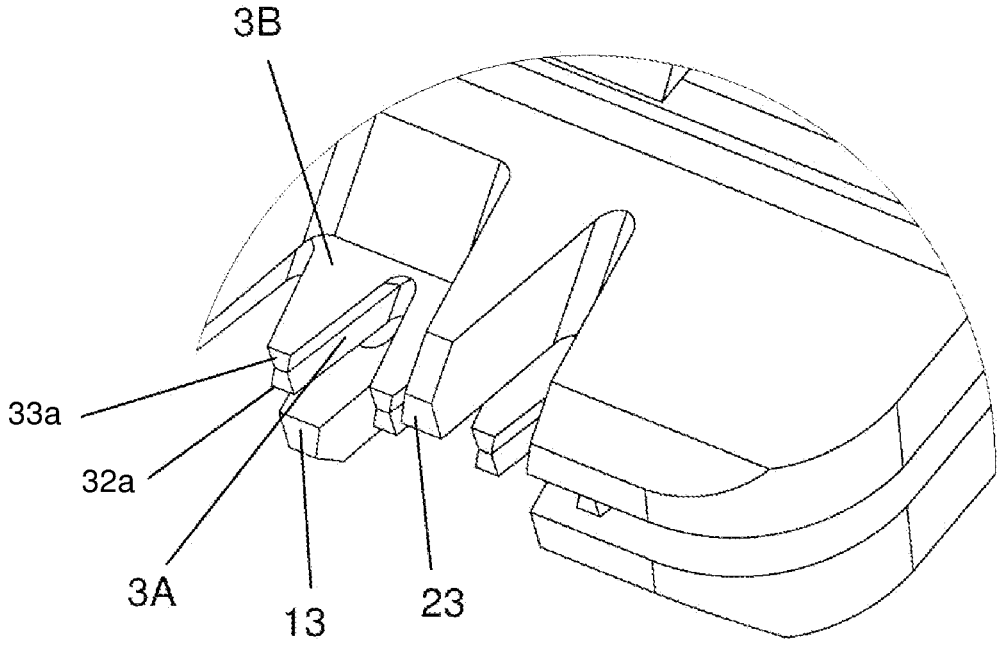
FIG. 16 shows the enlarged view of the portion A of FIG. 15.

FIGS. 15 and 16 illustrate the fifth embodiment of the present invention. The fifth embodiment is similar to the fourth embodiment except for the following. In this embodiment, the movable blade assembly comprises a lower movable blade 3A provided with a toothed front edge constituting the lower portion 32*a* of the third toothed front edge in the first embodiment, and an upper movable blade 3B disposed fixedly on top of the lower movable blade 3A and provided with a toothed front edge constituting the upper portion 33*a* of the third toothed front edge in the first embodiment. The teeth of the toothed front edge of the lower movable blade 3A and the toothed front edge of the upper movable blade 3B overlap with each other. Each tooth of the toothed front edge of the lower movable blade 3A has a cross-sectional shape of an isosceles trapezoid, and each tooth of the toothed front edge of the upper movable blade 3B has a cross-sectional shape of an inverted isosceles trapezoid. Other structures of this embodiment are similar to those of the fourth embodiment and are therefore not described in detail.

Figure 17:
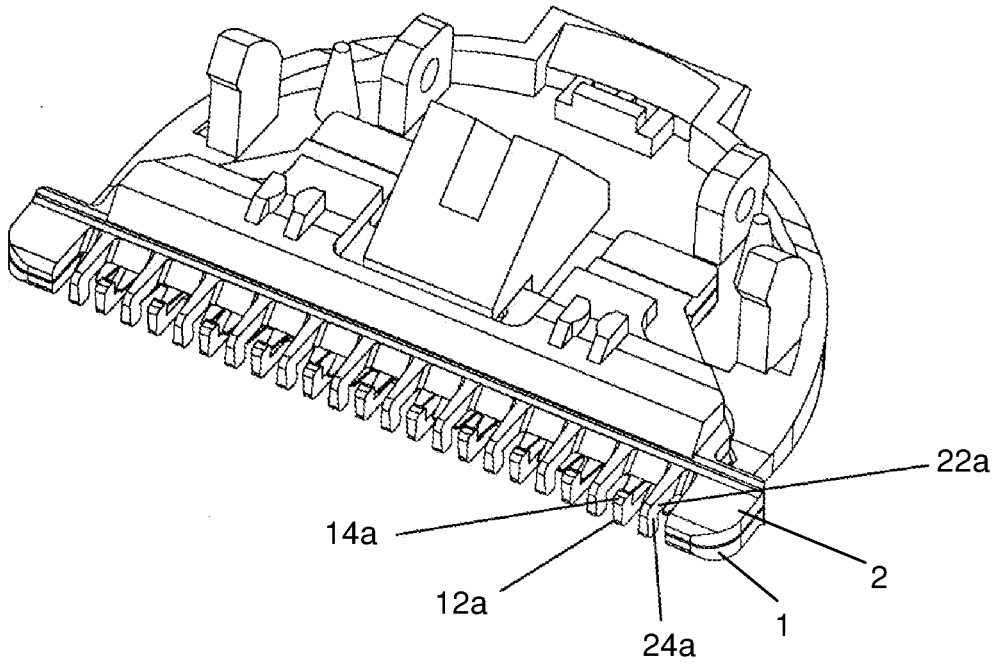
FIG. 17 shows the perspective view of the assembled blade set of the sixth embodiment.

FIG. 17 illustrates the sixth embodiment of the present invention. The sixth embodiment is similar to the fourth embodiment except for the following. In this embodiment, each tooth 12*a* of the first toothed front edge of the lower fixed blade 1 is integrally provided with a first protecting piece 14*a* extending upward from a front end thereof, and each tooth 22*a* of the second toothed front edge 21*a* of the upper fixed blade 2 is integrally provided with a second protecting piece 24*a* extending downward from a front end thereof. The thickness of the first and second protecting pieces 14*a*, 24*a* is adapted to allow the movable blade assembly 3 to reciprocate laterally. The first and second protecting pieces 14*a*, 24*a* protect the user's hand from getting injured by the movable blade assembly. Other structures of this embodiment are similar to those of the fourth embodiment and are therefore not described in detail.

Figure 18:
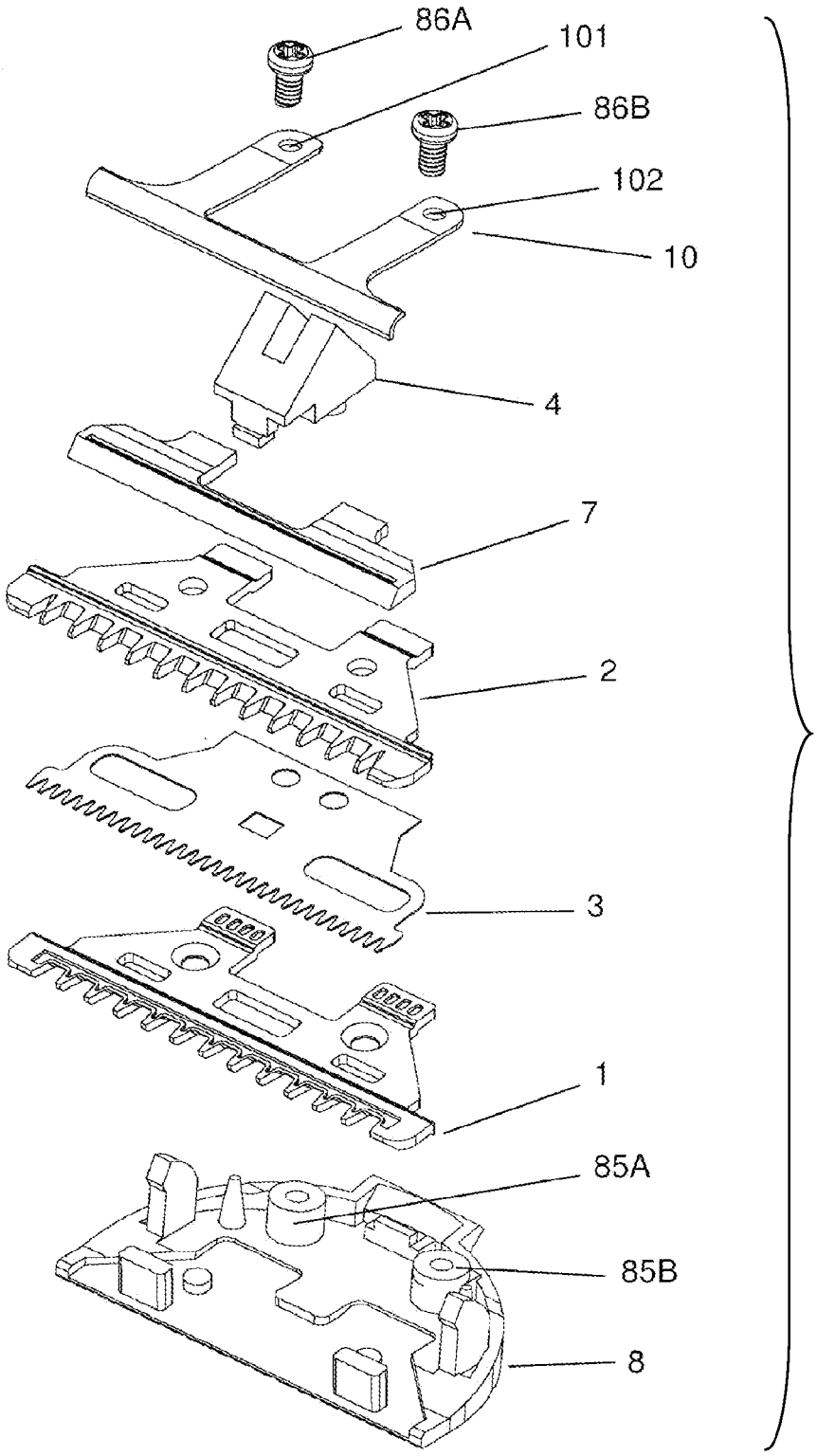
FIG. 18 shows the exploded view of the blade set of the seventh embodiment.

FIG. 18 illustrates the seventh embodiment of the present invention. The seventh embodiment is similar to the fourth embodiment except for the following. In this embodiment, a spring plate 10 is disposed on top of the pressing piece 7 to exert pressure against the pressing piece 7. A rear end of the base 8 is provided with two nuts 85A, 85B, one on the left side and one on the right side, for receiving two screws 86A, 86B which pass through two corresponding holes 101, 102 on the spring plate 10. Other structures of this embodiment are similar to those of the fourth embodiment and are therefore not described in detail.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A blade set for hair clippers which comprises a lower fixed blade with a first toothed front edge;

an upper fixed blade with a second toothed front edge which is disposed on top of the lower fixed blade and aligned corresponding to the lower fixed blade;

a movable blade assembly which is flat and extends in a plane parallel to a lengthwise plane of the upper fixed blade and a lengthwise plane of the lower fixed blade and disposed in between the lower fixed blade and the upper fixed blade in such a way that a user's skin is protected from getting injured by the movable blade assembly;

a driving means connected to the movable blade assembly to reciprocate the movable blade assembly laterally relative to the lower fixed blade and the upper fixed blade in an operating condition;

a third toothed front edge provided at a front end of the movable blade assembly, a lower portion of which cooperates with an upper portion of the first toothed front edge to define a first cutting surface, and an upper portion of which cooperates with a lower portion of the second toothed front edge to define a second cutting surface, and the first cutting surface and the second cutting surface are configured to cut hairs on same side of the user's skin at one time; and a blade holder which secures the lower fixed blade, the movable blade assembly and the upper fixed blade together to form a blade set and the blade set is connected to the hair clippers;

the blade holder comprises an upper pressing piece and a lower pressing piece; two springs are disposed between the upper pressing piece and the lower pressing piece in such a way to press the lower pressing piece against a top surface of the upper fixed blade; the lower pressing piece is provided with two recesses for receiving lower portions of the two springs respectively, and the upper pressing piece is provided with two receptacles for receiving upper portions of the two springs respectively.

2. The blade set for hair dippers as in claim 1, wherein the teeth of the first toothed front edge and the second toothed front edge do not overlap with each other.

3. The blade set for hair clippers as in claim 1, wherein the lower fixed blade is provided with a first toothed rear edge opposite to the first toothed front edge; the upper fixed blade is provided with a second toothed rear edge opposite to the second toothed front edge; a rear end of the movable blade assembly is provided with a third toothed rear edge, a lower portion of which cooperates with an upper portion of the first toothed rear edge to define a third cutting surface, and an upper portion of which cooperates with a lower portion of the second toothed rear edge to define a fourth cutting surface, and the third cutting surface and the fourth cutting surface are configured to cut hairs on same side of the user's skin at one time.

4. The blade set for hair clippers as in claim 3, wherein the teeth of the first toothed rear edge and the second toothed rear edge do not overlap with each other.

5. The blade set for hair clippers as in claim 1, wherein the movable blade assembly comprises one blade, and the blade is provided with a toothed front edge constituting the third toothed front edge and each tooth thereof has a cross-sectional shape of a rectangle.

6. The blade set for hair clippers as in claim 3, wherein the movable blade assembly comprises one blade; the blade is provided with a toothed front edge constituting the third toothed front edge and each tooth thereof has a cross-sectional shape of a rectangle, and the blade is also provided with a toothed rear edge constituting the third toothed rear edge and each tooth thereof has a cross-sectional shape of a rectangle.

7. The blade set for hair clippers as in claim 1, wherein the movable blade assembly comprises a lower movable blade provided with a toothed front edge constituting the lower portion of the third toothed front edge, and an upper movable blade disposed fixedly on top of the lower movable blade and provided with a toothed front edge constituting the upper portion of the third toothed front edge, and the teeth of the toothed front edge of the lower movable blade and the toothed front edge of the upper movable blade overlap with each other.

8. The blade set for hair clippers as in claim 3, wherein the movable blade assembly comprises a lower movable blade provided with a toothed front edge constituting the lower portion of the third toothed front edge, and an upper movable blade disposed fixedly on top of the lower movable blade and provided with a toothed front edge constituting the upper portion of the third toothed front edge, and the teeth of the toothed front edge of the lower movable blade and the toothed front edge of the upper movable blade overlap with each other; the lower movable blade is provided with a toothed rear edge constituting the lower portion of the third toothed rear edge, and the upper movable blade is provided with a toothed rear edge constituting the upper portion of the third toothed rear edge, and the teeth of the toothed rear edge of the lower movable blade and the toothed rear edge of the upper movable blade overlap with each other.

9. The blade set for hair clippers as in claim 7, wherein each tooth of the toothed front edge of the lower movable blade has a cross-sectional shape of an isosceles trapezoid, and each tooth of the toothed front edge of the upper movable blade has a cross-sectional shape of an inverted isosceles trapezoid.

10. The blade set for hair clippers as in claim 8, wherein each tooth of the toothed front edge of the lower movable blade has a cross-sectional shape of an isosceles trapezoid, and each tooth of the toothed front edge of the upper movable blade has a cross-sectional shape of an inverted isosceles trapezoid; each tooth of the toothed rear edge of the lower movable blade has a cross-sectional shape of an isosceles trapezoid, and each tooth of the toothed rear edge of the upper movable blade has a cross-sectional shape of an inverted isosceles trapezoid.

11. The blade set for hair clippers as in claim 1, wherein each tooth of the first toothed front edge of the lower fixed blade is integrally provided with a first protecting piece extending upward from a front end thereof, and each tooth of the second toothed front edge of the upper fixed blade is integrally provided with a second protecting piece extending downward from a front end thereof, and the thickness of the first and second protecting pieces is adapted to allow the movable blade assembly to reciprocate laterally.

12. The blade set for hair clippers as in claim 3, wherein each tooth of the first toothed front edge of the lower fixed blade is integrally provided with a first protecting piece extending upward from a front end thereof, and each tooth of the second toothed front edge of the upper fixed blade is integrally provided with a second protecting piece extending downward from a front end thereof, and the thickness of the first and second protecting pieces is adapted to allow the movable blade assembly to reciprocate laterally; each tooth of the first toothed rear edge of the lower fixed blade is integrally provided with a third protecting piece extending upward from a rear end thereof, and each tooth of the second toothed rear edge of the upper fixed blade is integrally provided with a fourth protecting piece extending downward from a rear end thereof, and the thickness of the third and fourth protecting pieces is adapted to allow the movable blade assembly to reciprocate laterally.

13. The blade set for hair clippers as in claim 1, wherein the blade holder further comprises a base; the base is provided with three pins which extend upward towards a lower surface of the lower pressing piece and pass through corresponding openings provided on each of the lower fixed blade, the movable blade assembly and the upper fixed blade, thereby securing the lower fixed blade, the movable blade assembly and the upper fixed blade in an assembled relation.

14. The blade set for hair clippers as in claim 13, wherein size of each opening of the movable blade assembly is larger than that of the corresponding pin so as to allow reciprocating actions of the movable blade assembly.

15. The blade set for hair clippers as in claim 14, wherein a guarding piece is disposed on top of each opening of the movable blade assembly for protecting the movable blade assembly from wear and tear during reciprocation.

16. The blade set for hair clippers as in claim 15, wherein the driving means passes through an opening provided at the upper pressing piece, an opening provided at the lower pressing piece, an opening provided at the upper fixed blade, an opening provided at the movable blade assembly, and an opening provided at the lower fixed blade; the opening of the movable blade assembly is sized to fittingly receive portion of the driving means passing through the opening.

17. The blade set for hair clippers as in claim 16, wherein the driving means is provided with a first connecting piece at a front end thereof and a second connecting piece at a rear end thereof; the movable blade assembly is provided with two notches corresponding to the first connecting piece and the second connecting piece respectively for receiving the first connecting piece and the second connecting piece.

18. The blade set for hair clippers as in claim 17, wherein the opening of the upper pressing piece, the opening of the lower pressing piece, the opening of the upper fixed blade and the opening of the lower fixed blade are sized to be larger than portion of the driving means passing through the respective openings.

19. The blade set for hair clippers as in claim 18, wherein the upper fixed blade and the lower fixed blade are each provided with a notch corresponding to the first connecting piece for receiving the first connecting piece, and the two notches are sized to be larger than the first connecting piece to allow reciprocating action of the driving means and the movable blade assembly.

* * * * *